United States Patent [19]

Warren

[11] 4,058,948

[45] Nov. 22, 1977

[54] INSULATED MASONRY BLOCK

[75] Inventor: Millard R. Warren, Knoxville, Tenn.

[73] Assignee: Warren Insulated Bloc, Inc., Knoxville, Tenn.

[21] Appl. No.: 649,795

[22] Filed: Jan. 16, 1976

Related U.S. Application Data

[63] Continuation-in-part of Ser. No. 606,934, Aug. 22, 1975.

[51] Int. Cl.[2] ..... E04B 2/00; E04B 5/30

[52] U.S. Cl. ..... 52/405; 52/323; 52/347; 52/404; 52/407

[58] Field of Search ..... 52/405, 91, 250, 323, 52/378, 379, 404, 406, 347, 412, 602, 504, 309, 408, 407, 220

[56] References Cited

U.S. PATENT DOCUMENTS

| | | | |
|---|---|---|---|
| 1,415,222 | 5/1922 | Cramer | 52/604 |
| 2,102,756 | 12/1937 | Smith et al. | 52/405 |
| 2,172,051 | 9/1939 | Robbins | 52/405 |
| 2,199,112 | 4/1940 | O'Leary | 52/405 |
| 2,199,946 | 5/1940 | Barnhart | 52/606 X |
| 2,852,934 | 9/1958 | Amundson | 52/405 |
| 3,204,381 | 9/1965 | Perreton | 52/504 |
| 3,318,062 | 5/1967 | Grants | 52/407 |
| 3,546,833 | 12/1970 | Perreton | 52/405 |
| 3,704,562 | 12/1972 | Grants | 52/405 |
| 3,885,363 | 5/1975 | Whittey | 52/405 |
| 3,982,369 | 9/1976 | Keleske | 52/407 |

FOREIGN PATENT DOCUMENTS

| | | | |
|---|---|---|---|
| 697,378 | 1964 | Canada | 52/405 |
| 784,309 | 1933 | France | 52/220 |
| 454,944 | 1950 | Italy | 52/606 |

*Primary Examiner*—Ernest R. Purser
*Assistant Examiner*—Robert C. Farber
*Attorney, Agent, or Firm*—Burns, Doane, Swecker & Mathis

[57] ABSTRACT

A masonry block comprises pairs of spaced opposed side walls and spaced opposed web walls forming a cavity therebetween. An insulative plate of thermally insulative material is disposed within the cavity. The insulative plate extends across the cavity from one to another of the web walls. The side walls each include a portion spaced from the insulative plate so as to define an air cell therebetween extending from one to another of the web walls. The side walls each further include another portion projecting into engagement with the plate to form an air barrier extending across the air cell from one to another of the web walls. Upon forming a wall with such insulated blocks, the air cells are sealed-off from one another to limit convection within the wall.

12 Claims, 12 Drawing Figures

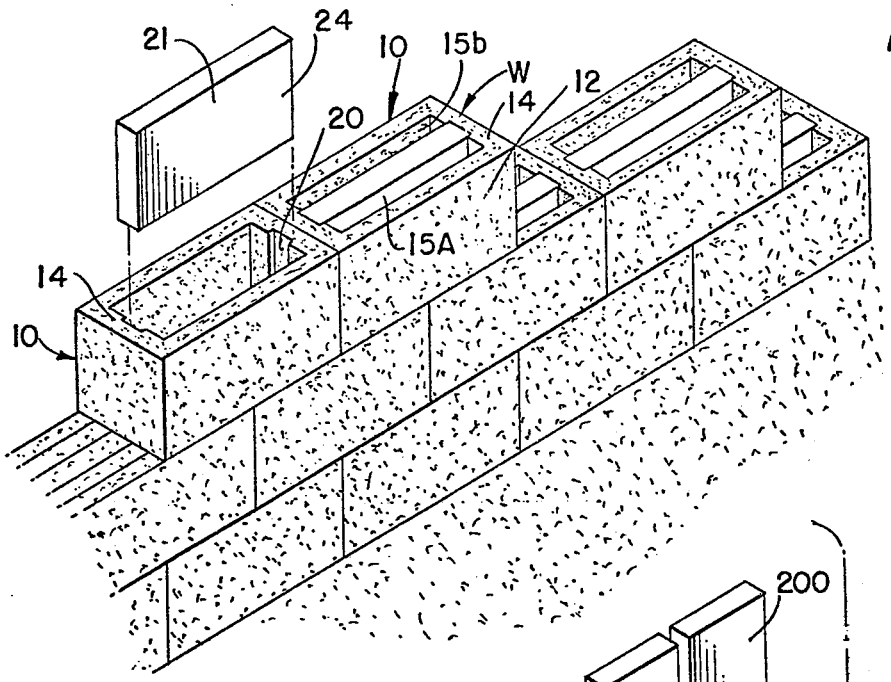
FIG. 1.
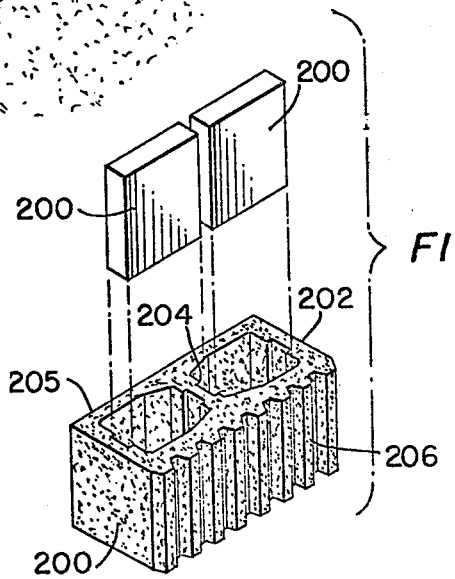
FIG. 4.
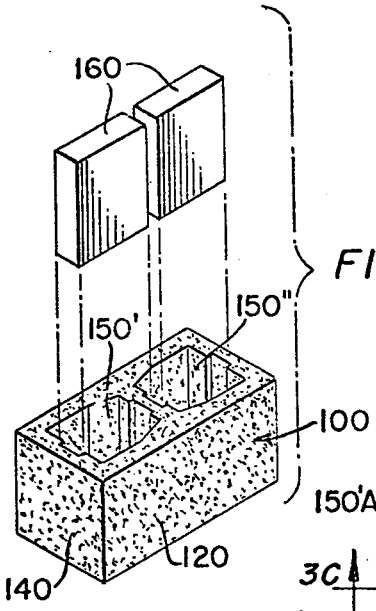
FIG. 3A.
FIG. 3B.
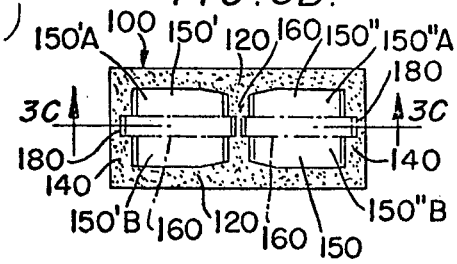
FIG. 2A.
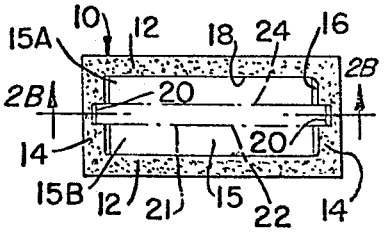
FIG. 3C.
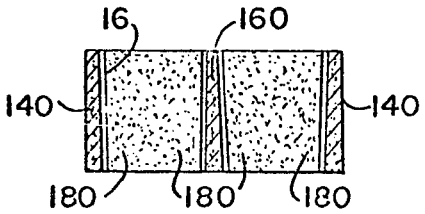
FIG. 2B.
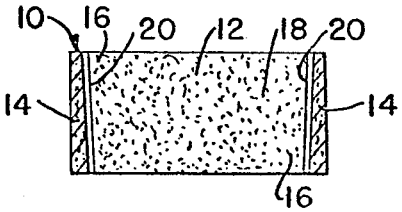

INSULATED MASONRY BLOCK

RELATED INVENTION

This is a continuation-in-part of copending and commonly assigned U.S. application Ser. No. 606,934 filed Aug. 22, 1975 by this inventor.

BACKGROUND AND OBJECTS OF THE INVENTION

The present invention relates to masonry blocks used in construction and more particularly to the thermal insulation of such a block.

The current world-wide emphasis on energy conservation has prompted the proposal of numerous techniques for thermal insulation of buildings and other structures. Heretofore, buildings have been insulated in many different ways, presenting problems of varying sorts. One common method of building construction involves the use of masonry blocks which are of concrete casting. The blocks are bonded together to form the shell of the building. Insulation of such walls by applying layers of thermally insulative material to the surfaces of these walls to meet the required thermal insulation standards involves considerable expense and loss of interior building space. These problems have prompted numerous proposals which involves the placement of a thermal insulation medium within a concrete block. In this connection, attention is directed to U.S. Pat. Nos. 1,884,319; 2,199,112; 2,852,934; 2,933,146; 3,204,381, 3,546,833; and 3,704,562 for examples of such structure.

Another proposal involves the placement of U-shaped styrofoam inserts within the recesses of concrete blocks. Each insert is installed such that the legs of the insert lie parallel to one another flush against the inside and outside walls of the block and with the bight portion of the insert lying flush against a web of the block so as to extend transverse to the inside and outside surfaces of the block.

Among the disadvantages that can arise from the previous proposals are undue cost and less than optimum thermal insulation. For instance those blocks which must be of special design to adapt to the insulation add significantly to cost. In some instances significant portions of the block must be removed, thereby presenting problems regarding structural strength of the blocks. Those blocks which eliminate the advantage of thermally insulative air cells, or which unduly limit the ratio between air volume and concrete volume within the block, are incapable of achieving optimum insulative results. Blocks in which an extent of the insulation extends from the outer to the inner block wall increase the thermal travel path to an undesirable degree, thereby limiting the thermal insulative effects that can be achieved.

It would be desirable from an insulative standpoint, to restrict the rate of circulation within the recesses or cavities within a wall formed by masonry blocks. The use of insulation inserts within the recesses generally does not prevent communication between the recesses of vertically superposed blocks forming the wall. The result is an extensive air space enabling a relatively large rate of air convection to accur within the wall. The use of multi-part inserts within the block recesses, such as disclosed in aforementioned U.S. Pat. No. 2,852,934, in an attempt to restrict internal air circulation can be quite expensive in terms of material costs as well as man hours required in assembling the blocks.

Therefore, it is an object of the present invention to provide an economical and easily assembled insulated block which incorporates insulative air cells and which restricts air circulation.

It is another object of the invention to provide such an insulated block which incorporates inserts of one-piece construction.

BRIEF DESCRIPTION OF THE INVENTION

These objects are achieved by the present invention which involves a masonry block comprising pairs of spaced opposed side walls and spaced opposed web walls forming a cavity therebetween. An insulative plate of thermally insulative material is disposed in the cavity. The insulative plate extends across the cavity from one to another of the web walls. The side walls each include a portion spaced from the insulative plate so as to define an air cell therebetween extending from one to another of the web walls. The side walls each further include another portion projecting toward and at least substantially engaging the plate to form an air barrier extending across the air cell from one to another of the web walls.

In a modified form of the invention, the insulative plate, rather than the side walls, includes portions which project toward and at least substantially engaging respective side wall surfaces to form the air barriers.

The blocks can be laid up and bonded by mortar to form a wall. Mortar joints are established along the upper edges of the side walls, web walls, and insulative plate to seal off the air cells in each block.

THE DRAWINGS

The invention is disclosed by way of preferred embodiments thereof depicted in the accompanying drawings wherein:

FIG. 1 depicts a plurality of insulated masonry blocks according to one embodiment of the invention in a stacked condition forming a wall;

FIG. 2A is a top plan view of the block depicted in FIG. 1;

FIG. 2B is a longitudinal sectional view taken along line 2B—2B of FIG. 2A;

FIG. 3A is an exploded isometric view of another preferred form of insulated masonry block according to the present invention;

FIG. 3B is a top plan view of the block depicted in FIG. 3A;

FIG. 3C is a longitudinal sectional view taken along line 3C—3C of FIG. 3B;

FIG. 4 is an exploded isometric view of another preferred form of insulated block according to the present invention;

DETAILED DESCRIPTION

Figure 5:
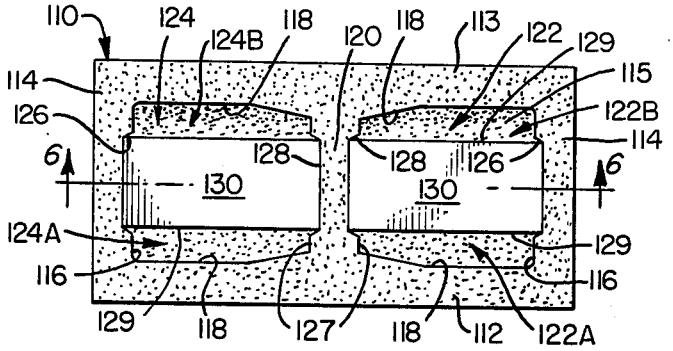
FIG. 5 is a plan view of a modified form of insulative block according to the present invention.

As disclosed in the inventor's aforementioned application, building blocks 10 are depicted in FIGS. 2A, 2B and in FIG. 1 forming a wall W. The block 10 includes a pair of opposed side walls 12 forming inner and outer portions of the wall W, and a pair of opposed web walls 14. Each block 10 is molded of masonry material, such as concrete, to form a hollow rectangular structure having a pair of opposed side walls 12 and a pair of opposed web or tie walls 14 extending between the ends of the side walls 12. The side and web walls define a cavity 15. The side walls 12 and the web walls 14 are of substantially the same thickness and define the outermost periphery of the block. The web walls 14 have mutually facing inner surfaces 16 which extend between mutually facing inner surfaces 18 of the side walls 12.

The cavity 15 is defined by both of the side walls 12. That is, there is only one cavity disposed between and defined by both side walls 12. As will be discussed subsequently, one or more additional web walls can be provided internally of the outermost web wall to partition the sole cavity 15 into cavity portions.

Each web wall 14 includes an internal channel 20 formed approximately midway between the ends of the web wall surfaces 16. As depicted in FIG. 2B, the channels 20 are in mutually facing relation, each extending in a top-to-bottom direction of the block 10. These channels may be formed during the molding process, or may be subsequently machined into the block. The channels 20 are preferably fashioned so as to converge inwardly from top to bottom, as depicted in FIG. 2B.

Mounted within the block 10 is a plate or panel 21 formed of thermally insulative material. The insulative plate 21 is positioned such that outer faces 22, 24 thereof extend between the web wall surfaces 16 in directions parallel to the side wall surfaces 18. In this fashion the plate 21 divides the cavity 15 into a pair of air cells 15A, B with each air cell 15A, B being bordered by: a portion of each web wall inner surface 16, one of the insulative plate faces 22, 24, and the side wall inner surface 18 which is in mutually facing relation to that inner plate face.

Thus, the arrangement is such that a masonry block 10 of substantially standard design is provided with a pair of air cells 15A, B separated by a layer of thermally insulative material for retarding heat and vapor transfer.

The type of insulative plate material to be employed, as well as its thickness, depends upon the degree of resistance to thermal conductivity that is desired. Possible types of insulative material include polystyrene, urethane, styrofoam, and fiberglass.

In use, the concrete block 10 is precast in a conventional manner. Suitable channels 20 can be formed during molding or machined into the web walls 14 subsequent to the molding operation. The insulative plate 21 is manually press-fitted into the channels 20. The convergent nature of the channels 20 causes the plate to be slightly compressed into a snug fit within the block. Insertion of the insulation plates can be accomplished at the block fabrication facility, or can be performed later at a building site.

The blocks 10 are used in a conventional manner in the erection of a structure as shown in FIG. 1. That is, the blocks 10 are laid-up in staggered or non-staggered relation, with the side walls 12 forming the interior and exterior wall surfaces of the structure. The insulative plates can be inserted before or after a row of blocks are laid-up merely pressing the plate into the channels 20. The convergent nature of the channels serves to firmly hold the plate in place. Bonding of the blocks together can be performed by conventional mortar application between blocks or by the application of a bonding resin to the exterior of the structure. One conventional type of such resin is sold by Owens-Corning Fiberglass Company under the trade name BlocBond. This resin has a portland cement base and is reinforced with fiberglass. Application of the resin is made in a one-eighth inch layer onto the exterior and interior surface of a wall of freestanding blocks. By thus eliminating the use of mortar the amount of non-insulated wall area is significantly reduced.

Since the block of the present invention involves only a pair of side walls with only one cavity disposed therebetween, the ratio of air volume to concrete volume is maximized to retain a high insulative factor. In certain prior art proposals there are employed a plurality of staggered cavities between the side walls, the added presence of masonry between the staggered cavities serving to reduce the air/concrete ratio.

Furthermore, the block of the present invention provides plural air gaps or cells 15A, B to retard thermal conductivity. It is expected that a significantly higher insulative factor is achieved when the insulative plate is disposed in spaced relation from both of the side walls 12, as opposed to being situated flush against one or both of the side walls.

Importantly, no portion of the insulative plate of the present block extends from one side wall to the other in flush engagement with a web wall, thus avoiding an enlargement of the effective heat transfer path.

Since the insulative plate 21 of the present invention extends across only one major dimension of the cavity 15 (i.e., parallel to the side walls) and since only one cavity is disposed between the side walls, only a minimal amount of insulative material is required per block.

Insulative materials of a waterproof nature, such as those previously listed, can be routinely employed to prevent the occurrence of water damage to the plates, especially during inclement conditions at the construction site.

The previously discussed principles and advantages can be incorporated with conventional masonry blocks of various design. FIGS. 3A–C depict a standard block 100 in which a pair of side walls 120 and web walls 140 define the outer periphery of the block and an inner cavity 150. The inner cavity 150 is partitioned into cavity portions 150', 150" by an intermediate web wall 160. Thus, the block 100 is characterized by a single cavity 150 disposed between and defined by the side walls 120, with the cavity 150 being divided into a plurality of cavity portions 150', 150" between the outer web walls 140.

Within each of the cavity portions 150', 150" an insulative plate portion 160 of the type previously discussed can be manually inserted. The insulative plate portion 160 is inserted into downwardly convergent channels 180 formed in the outer web walls 140 and intermediate web wall 160. As a result, each insulative plate partitions its respective cavity portion into a pair of air cells 150'A, B and 150"A, B.

In FIG. 4 the use of insulative plates 200 is depicted in conjunction with a conventional block 202 having an intermediate web wall 204, a planar side wall 205 and a corrugated side wall 206.

It will thus be realized that the embodiments disclosed in conjunction with FIGS. 3 and 4 are characterized by the provision of a masonry block having only a single cavity interposed between and defined by the side walls, and plural air cells separated by a layer of insulation, as in the manner of the embodiment disclosed in conjunction with FIGS. 2A, 2B.

Blocks of a design other than that depicted in FIGS. 2, 3, and 4 and other than a standard design can, if desired, be utilized in accordance with the aforestated principles of the invention.

In order to demonstrate the insulative effectiveness of the present invention, thermal conductivity factors have been calculated for an eight inch masonry block of the type disclosed in conjunction with FIGS. 3A–C having web length and depth dimensions of seven and five-eighths inches and a side length of fifteen and five-eighths inches. The thickness of each side wall is approximately one and one-quarter inches. An insulation plate thickness of one and one-half inches provides air cells of about one and eight-tenths inches on each side of each insulation plate portion. Total insulation area is about 92.45 square inches. The table below indicates the conductivity rates, i.e., U factors calculated for such a block design formed of concrete having various weight values with different types of insulative material:

| Concrete Weight | Insulation Thickness | Inside Density Designation | Insulation Material | U Factor |
|---|---|---|---|---|
| # 60 | 1" | 1# | Polystyrene | .128 |
| # 80 | 1" | 1½# | Polystyrene | .144 |
| #100 | 1½" | 1½# | Polystyrene | .122 |
| #100 | 2" | 2# | Polystyrene | .095 |
| #100 | 3" | 2# | Urethane | .059 |
| #100 | 4" | 2# | Urethane | .044 |
| #120 | 1½" | 2# | Polystyrene | .089 |
| #120 | 2" | 2# | Urethane | .088 |
| #140 | 2" | 2# | Polystyrene | .099 |
| #140 | 2" | 2# | Urethane | .085 |
| #140 | 4" | 2# | Urethane | .048 |

It will be appreciated from a review of the foregoing chart that extremely low U factors are available in accordance with the present invention.

In FIGS. 5–8 there is depicted a preferred insulative block of the present invention which effectively minimizes air convection within a construction wall. In FIG. 5, a block 110 is shown having front and rear opposed side walls 112, 113 and a pair of opposed end web walls 114. The side and end web walls define a cavity 115 therebetween. The side walls 112, 113 and the end web walls 114 are of substantially the same thickness and define the outermost periphery of the block. The end web walls 114 have mutually facing inner surfaces 116 which extend between mutually facing inner surfaces 118 of the side walls 112, 113.

The cavity 115 is defined by both of the side walls. That is, there is only one cavity 115 disposed between and defined by both side walls 112, 113. An intermediate web wall 120 is provided internally of the end web walls 114 to partition the cavity 115 into cavity portions 122, 124.

Figure 6:
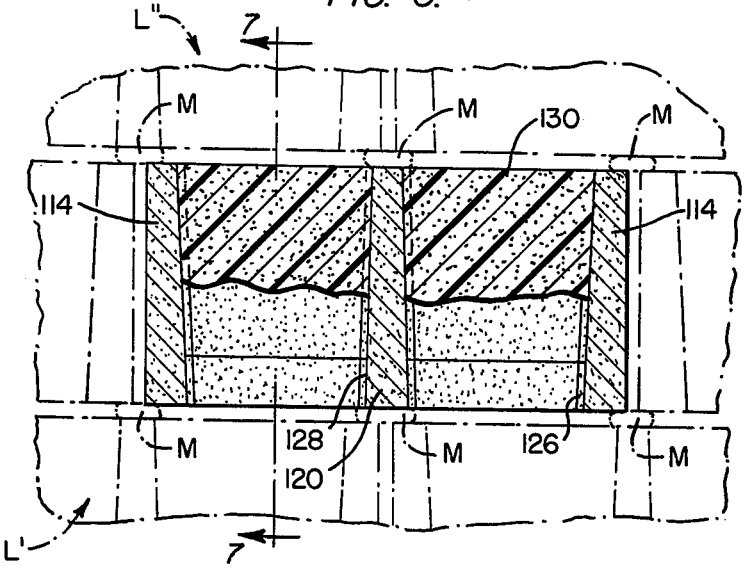
FIG. 6 is a longitudinal sectional view taken along line 6—6 of FIG. 5 and depicting a wall formed by blocks of the present invention laid up by mortar.

Each end web wall 114 includes an internal channel 126 formed approximately midway between the ends of the end web wall surfaces 116. As depicted in FIG. 6, these channels are in mutually facing relation, each extending in a top-to-bottom direction of the block 110. Such channels may be formed during the molding process, or may be subsequently machined into the block, and are preferably fashioned so as to converge inwardly from top to bottom, as depicted in FIG. 6.

The intermediate web wall has inner faces 127 in which are formed a pair of upright channels 128 each of which face one of the end web wall channels 126.

Mounted within the block 110 are a pair of plate or panel portions 130 formed of thermally insulative material. Each insulative plate 130 is positioned such that outer faces 129 thereof extend between the web wall surfaces 116 in directions parallel to the side wall surfaces 118. In this fashion, the plates 130 divide each cavity portion 122, 124 into a pair of air cells 122A, B; 124A, B, with each such air cell being bordered by: a portion of one end web wall inner surface 116, a portion of one of the intermediate web wall faces 127, one of the insulative plate faces 129, and the side wall inner surface 118 which is in mutually facing relation to such plate face.

Thus, the arrangement is such that a masonry block 110 is provided with a plurality of air cells separated by a layer of thermally insulative material for retarding heat and vapor transfer.

The type of insulative plate material to be employed, as well as its thickness, depends upon the degree of resistance to thermal conductivity that is desired. Possible types of insulative material include polystyrene, urethane, styrofoam, and fiberglass.

At their bottom ends, the side walls each include a projecting barrier portion 132 (FIG. 7) which projects toward one of the surfaces 129 of the insulative plate 132 and at least substantially into engagement therewith. The barrier portions 132 are formed by downward and inward tapers 134 of the side walls which terminate in the bottom plane of the block. Consequently, the side walls 112, 113 each comprise an upper portion which is spaced from one of the plate surfaces 129 to define the air cells 122A, B or 124A, B, and another, lower portion 132 which is at least in substantial engagement with both surfaces of the plate. The air cells thus extend from one web wall 114 to another 120 and are blocked therealong by air barriers formed by the barrier portions 132.

The blocks 110 can be conveniently molded in a manner incorporating the barrier portions. The number and location of the barrier portions 132 is optional. Such barrier portions can be disposed at the base of the side walls and/or at the top thereof, and/or vertically therebetween.

Figure 7:
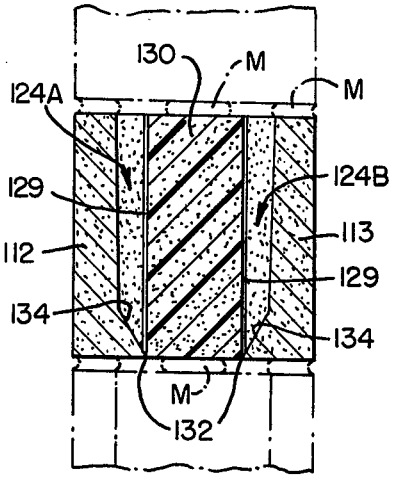
FIG. 7 is a vertical cross-sectional view taken along line 7—7 of FIG. 6.
Figure 8:
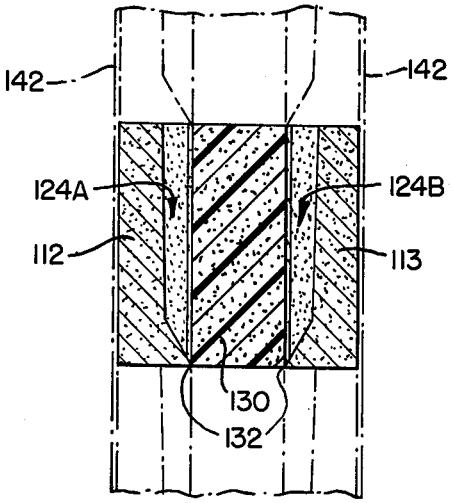
FIG. 8 is a cross-sectional view similar to FIG. 6 depicting a wall of blocks that have been laid up by a bonding resin.

During assemblage of the blocks 110 into a wall structure, a layer L′ of blocks is laid and mortar layers M are deposited on the top face of each block 1 as defined by the upper edges of the side walls and web walls (FIG. 6). A layer of mortar M is also deposited entirely along the top edge of the insulation plates 130 (FIG. 7). Another layer L″ of blocks is than assembled atop the first layer. The mortar layers situated between the two block layers function to bond the blocks together and to seal off the air cells 122A, B; 124A, B. Particularly, the mortar along the plates seals the front air cells of each block from the rear air cells. Consequently, the air within each air cell is confined at the bottom by the barrier portion 132 of the associated block; at the top by the barrier 132 of the block thereabove and the mortar joints along the side walls, web walls and insulative plate; and at the ends by the web walls. The air is thus effectively contained within the height of the block, thereby minimizing the rate of air convection that can occur within the wall.

It is noted that the barrier portions 132 are preferably spaced apart by a distance equal to or slightly less than the expected width of the insulative plate 130 so as to assure a tight fit between the plate and the barrier portions.

To assemble the blocks 110 and the insulative plates 130, it is merely necessary to cut stock plate material to the necessary length, i.e., larger than the distance between the layer ends of the channels 126, 128 and equal to or shorter than the distance between the upper ends of these channels. The plates are then pressed into the channels 126, 128 so that the parallel upright ends of the plates are compressed, or wedged into firm engagement with the convergent channels 126, 128.

It should be noted that a wall of blocks 110 can be laid up by means of the bonding resin process described previously, and as depicted in FIG. 8. In such instance, the air cells 122A, B; 124A, B are sealed by means of the inner and out layers 142 of bonding resin, the barrier portions 132 of vertically adjacent blocks, and contact between the vertically superposed insulative plates 130. Thus, the height of the air cells is limited to minimize the rate of convection, and the travel of warm air from the inner air cells to the colder air in the outer air cells is resisted.

Figure 9:
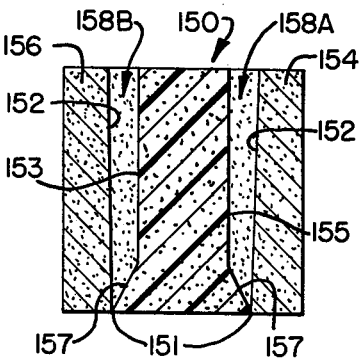
FIG. 9 is a cross-sectional view of a modified form of block depicted in FIG. 5.

In a modified form of the invention, depicted in FIG. 9, the insulative plate 150 comprises a one-piece element which includes integral barrier portions 151 projecting from opposite surfaces 153, 155 of the plate toward inner surfaces 152 of the side walls 154, 156. These barrier portions are established by downwardly and outwardly tapered sections 157. Thus, in such a case as previously, an upper portion of each plate 150 is spaced from the block side walls to define an air cell 158A or B and another, integral, lower portion 151 of the plate at least substantially engages the side walls to form an air barrier extending across the air cell from one to another web wall. In such an arrangement, the upper and lower extents of the insulative plate are preferably situated within the upper and lower planes of the block.

It should be realized that while the invention disclosed in conjunction with FIGS. 5–9 has been discussed in connection with a masonry block having end web walls and at least one intermediate wall, it will be realized that the invention is equally applicable to a masonry block having no intermediate web wall, such as depicted in FIG. 1. In such an instance, the projecting barrier portions 132 or 151 would extend from one end web wall to the other.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A masonry block comprising:

pairs of spaced opposed side walls and spaced opposed web walls of integral construction forming cavity means therebetween which is open at opposite ends;

at least one of said web walls extending between terminal ends of said side walls defining an outer peripheral portion of said block; and a substantially rectangular insulative plate means of thermally insulative material disposed in said cavity means;

said insulative plate means extending across said cavity means from one to another of said web walls and terminating at said web walls;

said insulative plate means including essentially flat side faces disposed parallel to said side walls;

said side walls each including:

a portion spaced from a respective side face of said insulative plate means so as to define an air cell therebetween extending from one to another of said web walls, and another portion projecting toward said respective side face of said plate means;

said other portions of said side walls having ends which are spaced apart by a distance substantially equal to the thickness of said plate means so that said other portions engage said plate means to form air barriers extending across both air cells from one to another of said web walls.

2. A masonry block according the claim 1 wherein said cavity means comprises only a single cavity disposed between and defined by both of said side walls.

3. A masonry block according to claim 2 wherein said web walls comprise an end web wall and an intermediate web wall defining a cavity portion therebetween, and further including another end web wall spaced from said intermediate web wall to establish an additional cavity portion therebetween; said plate means comprising a pair of plate portions disposed in said cavity portions.

4. A masonry block according to claim 1 wherein said other portion of each side wall comprises a section which is tapered inwardly and away from the end of the cavity in which the plate means is to be installed.

5. A masonry block according to claim 4 wherein said plate means is press-fit within channels formed in said web walls.

6. A masonry block comprising:

pairs of spaced opposed side walls and spaced opposed web walls forming cavity means therebetween which is open at both ends;

at least one of said web walls extending between terminal ends of said side walls and defining an outer peripheral portion of said blocks and a substantially rectangular insulative plate means of thermally insulative material disposed in said cavity means;

said insulative plate means extending across said cavity means from one to another of said walls and terminating at said web walls;

said insulative plate means including first and second side surfaces facing respective ones of said walls, each of said surfaces including:

an upper portion spaced from its respective side wall so as to define an air cell therebetween extending from one to another of said web walls, and a lower portion, integrally connected with said one portion and flared downwardly and outwardly therefrom into at least engagement with said side wall surfaces to form an air barrier extending across the bottoms of said air cells from one to another of said web walls.

7. A mansonry block according to claim 6 wherein said cavity means comprises only a single cavity disposed between and defined by both of said side walls.

8. A masonry block according to claim 7 wherein said web walls comprise an end web wall and an intermediate web wall defining a cavity portion therebetween, and further including another end web wall spaced from said intermediate web wall to establish an additional cavity portion therebetween; said plate means comprising a pair of plate portions disposed in said cavity portions.

9. A masonry block according to claim 6 wherein said other portion of each surface of said insulative plate means comprises a downwardly and outwardly tapered section defining a barrier portion at a lower part of each said surface; said barrier portions of said plate means being spaced apart by a distance substantially equal to the distance between said side walls.

10. A masonry block according to claim 9 wherein said plate means is press-fit within channels formed in said web walls.

11. In a construction wall comprising a plurality of layers of masonry block laid atop one another and bonded together, each block comprising pairs of spaced opposed side walls and spaced opposed web walls forming cavity means therebetween which is open at both ends, at least one of said web walls extending between terminal ends of said side walls and defining an outer peripheral portion of said block, and substantially rectangular insulative plate means of thermally insulative material disposed in said cavity means and including essentially flat side faces which extend across said cavity means from one to another web wall and terminating at said web walls, the improvement wherein:

said side walls each include:

a portion spaced from a respective side face of said insulative plate means so as to define an air cell therebetween extending from one to another of said web walls, another portion projecting toward and at least substantially engaging said respective side face of said plate means to form an air barrier extending across said air cell from one to another of said web walls; and vertically adjoining blocks of said layers being bonded together by mortar joints disposed between vertically facing edges of said side and web walls and between vertically facing edges of said insulative plate means;

each air cell defined by vertically adjacent air barriers being free of insulative material.

12. In a construction wall comprising a plurality of layers of masonry block laid atop one another and bonded together, each block comprising pairs of spaced opposed side walls and spaced opposed web walls forming cavity means therebetween which is open at both ends, at least one of said web walls extending between terminal ends of said side walls and defining an outer peripheral portion of said block, and substantially rectangular insulative plate means of thermally insulative material disposed in said cavity means so as to extend across said cavity means from one to another web wall and terminating at said web walls, the improvement wherein:

said insulative plate means including first and second side surfaces facing respective ones of said walls, each of said surfaces including:

an upper portion spaced from its respective side wall so as to define an air cell therebetween extending from one to another of said web walls, and a lower portion, integrally connected with said one portion and flared downwardly and outwardly therefrom into engagement with said side wall surfaces to form an air barrier extending across the bottoms of said air cells from one to another of said web walls;

vertically adjoining blocks of said layers being bonded together by mortar joints disposed between vertically facing edges of said side and web walls and between vertically facing edges of said insulative plate means;

each air cell defined by vertically adjacent air barriers being free of insulative material.

* * * * *